United States Patent [19]

Gaulden et al.

[11] Patent Number: 4,468,806

[45] Date of Patent: Aug. 28, 1984

[54] STERO SPEAKER MIXER

[76] Inventors: Joe L. Gaulden, P.O. Box 1499, Lewisville, Tex. 75067; Perry L. Compton, P.O. Box 78607, The Colony, Tex. 75056

[21] Appl. No.: 494,424

[22] Filed: May 13, 1983

[51] Int. Cl.[3] ..... H04R 3/12

[52] U.S. Cl. ..... 381/123; 381/81; 381/85

[58] Field of Search ..... 381/119, 123, 24, 25, 381/80, 81, 82, 85, 55, 120, 121, 116, 117; 333/17 M

[56] References Cited

U.S. PATENT DOCUMENTS

| | | | |
|---|---|---|---|
| 3,370,125 | 2/1968 | Shaw et al. | 179/1 |
| 3,694,764 | 9/1972 | Barron | 330/146 |
| 3,881,058 | 4/1975 | Klauck | 179/1 A |
| 3,959,736 | 5/1976 | GrosJean | 330/207 P |
| 4,004,095 | 1/1977 | Cardone | 179/1 GQ |
| 4,176,251 | 11/1979 | Odlen et al. | 179/1 SW |

*Primary Examiner*—A. D. Pellinen
*Assistant Examiner*—Brady W. J.
*Attorney, Agent, or Firm*—Hubbard, Thurman, Turner & Tucker

[57] ABSTRACT

A stereo speaker mixer is disclosed for coupling a plurality of pairs of stereo speakers to the output of an amplifier. A plurality of manually operable selection switches is provided for selecting and coupling in parallel a particular number of speaker pairs. The position of the these switches is detected and decoded by digital logic circuitry which is utilized to couple an appropriate value impedance matching device between the amplifier and the selected number of speaker pairs in response to the actual number of speaker pairs selected. A safety circuit is provided which ensures that at least one pair of speakers is always coupled to the amplifier output without regard to the position of the selection switches, thereby preventing the sudden and unexpected application of amplifier output to a speaker pair.

12 Claims, 1 Drawing Figure

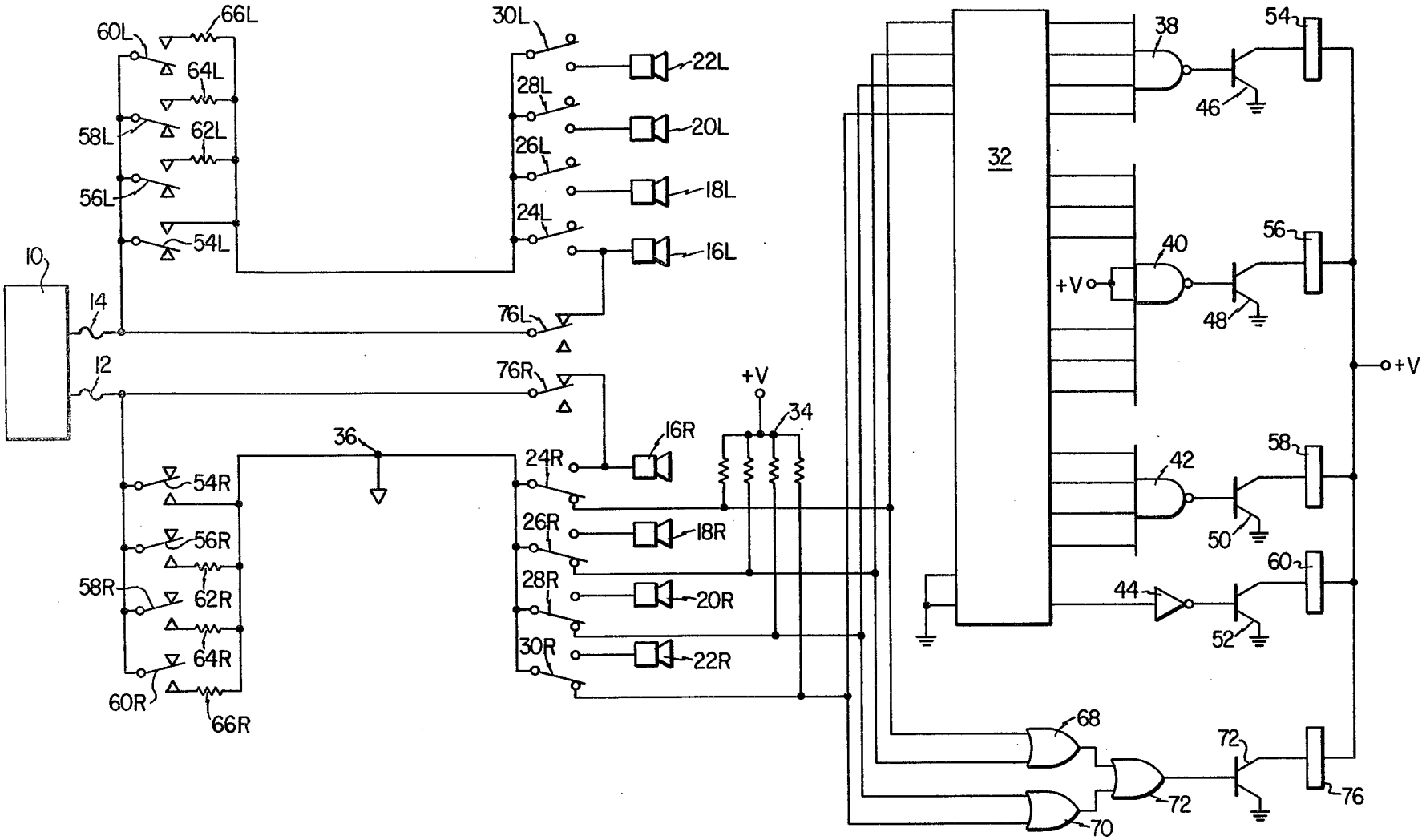
+V
54
56
58
60
76
46
48
50
52
72
38
40
42
44
72
68
70
+V
32
34
+V
22L
20L
18L
16L
16R
18R
20R
22R
30L
28L
26L
24L
76L
76R
24R
26R
28R
30R
36
66L
64L
62L
54L
54R
56R
62R
64R
66R
60L
58L
56L
58R
60R
14
12
10

STERO SPEAKER MIXER

BACKGROUND OF THE INVENTION

This invention relates to stereo systems in general and in particular to stereo speaker systems which permit a plurality of stereo speakers pairs to be coupled to a single amplifier output.

Stereo speaker systems which incorporate multiple pairs of stereo speakers are well known in the art. Many known stereo amplifiers provide multiple power outputs for coupling up to two pairs of speakers to the amplifier; however, the desire of the American consumer to utilize a greater number of speaker pairs has generally been thwarted by such known systems and has resulted in various unacceptable known techniques for coupling additional speaker pairs to an amplifier designed to drive one or two pairs of speakers.

A major problem associated with the coupling of additional pairs of speakers to known amplifier systems has been the failure of such known approaches to provide a proper impedance match between the amplifier output and the resultant speaker load. Those ordinarily skilled in the electrical art will appreciate that a typical stereo speaker has an impedance of eight ohms and that two such speakers coupled together will have an impedance of sixteen ohms when coupled in series and four ohms when coupled in parallel. This variation in load impedance from the output impedance of the amplifier results in power losses between the amplifier and the load and an unacceptable system.

Certain crude mechanical switching systems are known in the art which will compensate for this impedance by mechanically coupling an impedance matching device into the circuit between the speaker and the amplifier; however, these mechanical devices are generally unreliable and subject to unacceptable variations which result in noticeable power losses.

Additionally, such known switching systems can result in damage to speaker systems where the switch is located between the speaker system and the amplifier. An operator may inadvertently turn the output of the amplifier quite high while forgetting that the switch is in a non-select position. The subsequent selecting of a particular speaker pair can then result in the sudden and sometimes disastrous application of large amounts of power to a single speaker pair.

SUMMARY OF THE INVENTION

It is therefore one object of the present invention to provide an improved stereo speaker mixer.

It is another object of the present invention to provide an improved stereo speaker mixer which utilizes digital logic circuitry to control impedance matching devices.

It is yet another object of the present invention to provide an improved stereo speaker mixer which can be easily and inexpensively constructed.

It is another object of the present invention to provide an improved stereo speaker mixer which includes a safety circuit whereby at least one pair of speakers is always coupled to the output of the amplifier.

The foregoing objects are achieved as is now described. A plurality of manually operable selection switches is provided for selecting and coupling in parallel a particular number of speaker pairs. The position of these switches is detected and decoded by digital logic circuitry which is utilized to couple an appropriate value impedance matching device between the amplifier and the selected number of speaker pairs in response to the actual number of speake pairs selected. A safety circuit is provided which ensures that at least one pair of speakers is always coupled to the amplifier output without regard to the position of the selection switches, thereby preventing the sudden and unexpected application of amplifier output to a speaker pair.

BRIEF DESCRIPTION OF THE DRAWINGS

The novel features believed characteristic of the invention are set forth in the appended claims. The invention itself; however, as well as a preferred mode for use, further objects and advantages thereof, will best be understood by reference to the following detailed description of an illustrative embodiment when read in conjunction with the accompanying drawing, wherein:

The single FIGURE depicts a schematic diagram of the stereo speaker mixer of the present invention.

DETAILED DESCRIPTION OF THE DRAWING

With reference now to the sole FIGURE, there is depicted a schematic diagram of the stereo speaker mixer of the present invention. An amplifier 10, is coupled via fused lines 12 and 14 to a plurality of speaker pairs 16L and 16R; 18L and 18R; 20L and 20R; and, 22L and 22R, with the L and R designating "left" and "right" for each pair of speakers. Those skilled in the art will appreciate that lines 12 and 14, although depicted schematically as a single line, are in actual fact implemented utilizing two conductor wire in a manner well known in the art.

A plurality of manually operable switching devices 24L and 24R; 26L and 26R; 28L and 28R; and, 30L and 30R are provided and utilized to permit the operator to manually select and couple in parallel a selected number of the total number of speaker pairs utilized. As can be seen, a standard double pole, double throw switch can be utilized to implement both the "left" and "right" side of each switch to permit simultaneous selection of both the left and right speaker of each pair. Those skilled in the electrical arts will appreciate that in alternate embodiments of the present invention, switches 24, 26, 28 and 30 may be implemented utilizing relays or other switching devices such as gate controlled conduction devices.

As can be seen in the FIGURE, the right side of switches 24, 26, 28 and 30 includes an additional contact which is coupled to certain inputs of integrated circuit 32. The logic level inputs to integrated circuit 32 are provided utilizing a power supply voltage which is coupled to each switch via a resistor contained in dropping resistor bank 34 while each switch is in the non-select mode. A floating (power supply) ground present at point 36 is utillized to drop the power supply voltage at each non-selected swtich to a low logic level. As those skilled in the art will appreciate, each switch which is placed in the select position will cause a high logic level to be coupled to integrated circuit 32 at its corresponding input.

Integrated circuit 32 is, in a preferred embodiment of the present invention, implemented utilizing a digital decoder circuit such as the 74LS154, "one of sixteen" decoder. Thus, each possible combination of switch positions for switches 24, 26, 28 and 30 will result in a single unique output of integrated circuit 32. Each of these outputs is then coupled to the input of an appropriate logic gate (38, 40, 42 or 44) to energize its associated relay drive transistor 46, 48, 50 or 52. In a manner well known in the art, relay drive transistors 46, 48, 50 and 52 are then individually utilized to energize relays 54, 56, 58 and 60 as may be appropriate. In operation a single relay which corresponds to the actual position of switches 24, 26, 28 and 30 is energized and utilized to close its corresponding pair of relay contacts.

Relay contacts 54L and 54R; 56L and 56R; 58L and 58R; and, 60L and 60R are then utilized to couple amplifier 10 directly to a selected single pair of speakers, or through a selected pair of impedance matching resistors. Thus, resistors 62L and 62R are implemented utilizing precision 4 ohm resistors to compensate for a second speaker pair in parallel with the initial speaker pair. Correspondingly, resistors 64L and 64R comprise precision 5.3 ohm resistors for utilization with three parallel couple speaker pairs, and resistors 66L and 66R comprise precision 6 ohm resistors for utilization with four parallel couple pairs of speakers. It should be apparent to those skilled in the art upon reference to this disclosure that the stereo speaker mixing apparatus of the present invention could be easily implemented utilizing more or less than four pairs of speakers, as may be desired.

An important aspect of the present invention is the safety circuitry which prevents a sudden application of amplifier power to a single pair of speakers. The outputs of switches 24, 26, 28 and 30 in addition to being coupled to the inputs of integrated circuit 32 are also coupled to the inputs of logic gates 68 and 70. Logic gates 68 and 70 are in turn coupled to logic gate 72 which will energize relay drive transistor 74 during those occasions when switches 24, 26, 28 and 30 are all in the non-select position. Relay drive transistor 74 is then utilized to energize relay 76 and relay contacts 76L and 76R and then utilized to couple speakers 16L and 16R directly to the output of amplifier 10. This circuitry is utilized to prevent the operator from increasing the power output of amplifier 10 to a very high level and then suddenly energizing a single pair of stereo speakers. In this manner, the circuitry comprising logic gates 68, 70 and 72 and relay 76 may be utilized to ensure that at least one single pair of speakers is continually coupled to the output of amplifier 10, regardless of the position of selection switches 24, 26, 28 and 30.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. Apparatus for coupling a plurality of speaker pairs to the output of an amplifier comprising:

switching means having multiple selectable states for coupling in parallel a selected number of speaker pairs from said plurality of speaker pairs;

a plurality of pairs of impedance matching resistive devices; and digital logic means coupled to said switching means for automatically coupling a selected pair of impedance matching resistive devices between the output of said amplifier and said selected number of parallel coupled speaker pairs in response to the states of said switching means.

2. The apparatus according to claim 1 wherein said plurality of speaker pairs comprises four speaker pairs.

3. The apparatus according to claim 2 wherein said plurality of pairs of impedance matching resistive devices comprises three pairs of precision resistors.

4. The apparatus according to claim 1 wherein said digital logic means includes a digital decoder coupled to said switching means.

5. The apparatus according to claim 4 wherein said digital logic means includes relay devices for coupling a selected pair of impedance matching resistive devices between the output of said amplifier and said selected number of parallel coupled speaker pairs in response to the output of said digital decoder.

6. The apparatus according to claim 1 wherein said switching means comprises a plurality of double pole double throw manually operable switches.

7. Apparatus for coupling a plurality of speaker pairs to the output of an amplifier comprising:

switching means having multiple selectable states for coupling in parallel a selected number of speaker pairs from said plurality of speaker pairs;

a plurality of pairs of impedance matching resistive devices;

digital logic means coupled to said switching means for automatically coupling a selected pair of impedance matching resistive devices between the output of said amplifier and said selected number of parallel coupled speaker pairs in response to the states of said switching means; and safety means for coupling at least one of said plurality of speaker pairs to the output of said amplifier in response to said selected number equaling zero.

8. The apparatus according to claim 7 wherein said plurality of speaker pairs comprises four speaker pairs.

9. The apparatus according to claim 8 wherein said plurality of pairs of impedance matching resistive devices comprises three pairs of precision resistors.

10. The apparatus according to claim 7 wherein said digital logic means includes a digital decoder coupled to said switching means.

11. The apparatus according to claim 10 wherein said digital logic means includes relay devices for coupling a selected pair of impedance matching resistive devices between the output of said amplifier and said selected number of parallel coupled speaker pairs in response to the output of said digital decoder.

12. The apparatus according to claim 7 wherein said switching means comprises a plurality of double pole double throw manually operable switches.

* * * * *

UNITED STATES PATENT AND TRADEMARK OFFICE

CERTIFICATE OF CORRECTION

PATENT NO. : 4,468,806

DATED : August 28, 1984

INVENTOR(S) : Joe L. Gaulden, Perry L. Compton

It is certified that error appears in the above-identified patent and that said Letters Patent is hereby corrected as shown below:

Column 1, line 7, "speakers" should be --speaker--.

Column 2, line 3, "speake" should be --speaker--.

Column 2, line 13, "for" should be --of--.

Column 2, line 57, "swtich" should be --switch--.

Column 2, line 56, "utillized" should be --utilized--.

Column 2, line 64, "74LS154, " should be --74LS154, a--.

Column 3, line 37, "and" in the third occurrence should be --are--.

Signed and Sealed this

*Fourth* Day of *June 1985*

[SEAL]

*Attest:*

DONALD J. QUIGG

*Attesting Officer* *Acting Commissioner of Patents and Trademarks*